US009006546B2

(12) United States Patent
Kunstadt

(10) Patent No.: US 9,006,546 B2
(45) Date of Patent: Apr. 14, 2015

(54) PERFORATED MUSICAL BOW

(71) Applicant: Robert M. Kunstadt, New York, NY (US)

(72) Inventor: Robert M. Kunstadt, New York, NY (US)

( * ) Notice: Subject to any disclaimer, the term of this patent is extended or adjusted under 35 U.S.C. 154(b) by 10 days.

(21) Appl. No.: 13/815,438

(22) Filed: Mar. 4, 2013

(65) Prior Publication Data

US 2014/0245876 A1 Sep. 4, 2014

(51) Int. Cl.
*G10D 1/00* (2006.01)
*G10D 3/16* (2006.01)

(52) U.S. Cl.
CPC ..... *G10D 3/16* (2013.01)

(58) Field of Classification Search
USPC ..... 84/274, 282, 283
See application file for complete search history.

(56) References Cited

U.S. PATENT DOCUMENTS

| | | | | |
|---|---|---|---|---|
| 2,252,929 | A | 8/1941 | Hedden | |
| 2,258,998 | A * | 10/1941 | Nebel | 84/282 |
| 3,143,913 | A * | 8/1964 | Bried | 84/282 |
| 4,015,501 | A * | 4/1977 | Schaller | 84/282 |

OTHER PUBLICATIONS

Vandoren LC37P Klassik, http://woodsys.com/p-1639-vandoren-lc37p-klassik.aspx.
Vandoren Klassik Series Ligature for German Clarinet—Plastic or Leather Cap, http://www.prowinds.com/product/5339/518?gclid=CMGHoYmqi7gCFYWe4Aodcj4AnQ#prodtabs.
The German String Ligature, http://www.woodwind.org/clarinet/Uploads/strnglig.html.

* cited by examiner

*Primary Examiner* — Kimberly Lockett

(57) ABSTRACT

A light and stiff bow for stringed musical instruments may comprise a tubular stick having a plurality of spaced perforations, provided with a frog, a head, and a tensioning arrangement.

7 Claims, 2 Drawing Sheets

PERFORATED MUSICAL BOW

FIELD OF THE INVENTION

This invention relates to the field of bows for use in playing stringed musical instruments, such as violin, viola, cello or string bass.

SUMMARY OF THE INVENTION

In accordance with the invention, a light and stiff bow may comprise a tubular stick having a plurality of spaced perforations, provided with a frog, a head, and a tensioning arrangement. According to the invention it is not necessary to utilize any rare or expensive rainforest woods such as pernambuco or ebony, since according to the invention a bow may be constructed from aluminum and nylon.

DETAILED DESCRIPTION OF THE INVENTION

Referring now to FIGS. 1-4, the invention will be described in detail.

Figure 1:
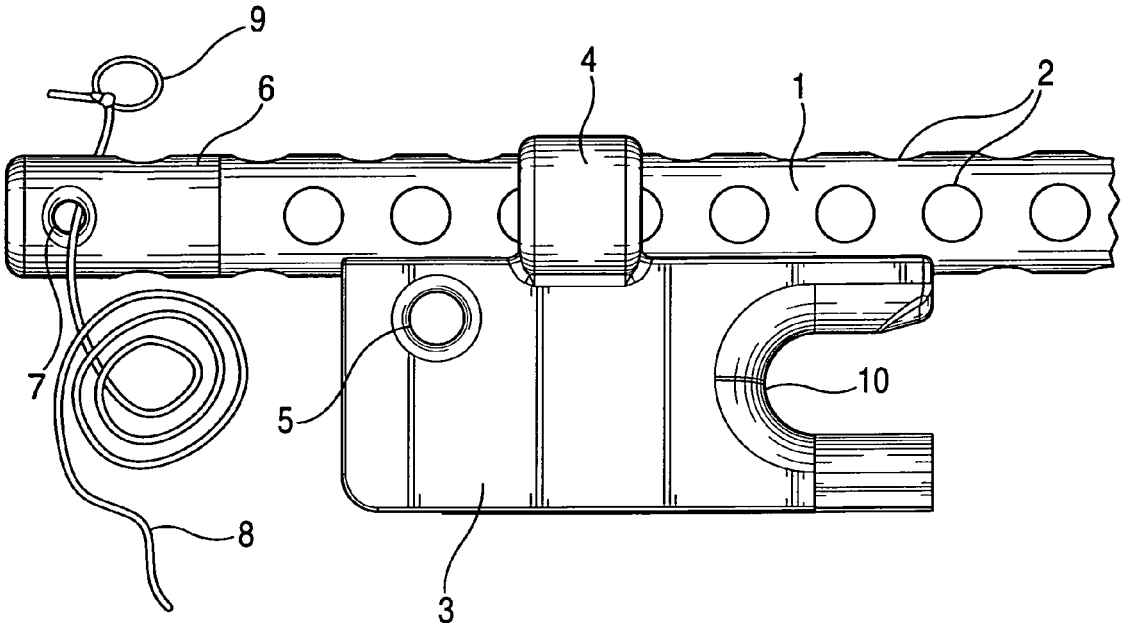
FIG. 1 is a side elevation of the handle portion of a bow according to the invention.

Referring now to FIG. 1, stick 1 comprises a hollow cylindrical tube approximately 28½" long. Stick 1 may be 6061 aluminum with an OD of ⅜" and a wall thickness of 1/32". Stick 1 may be tempered for added strength, e.g., T6. Other suitable lightweight, durable and appropriately-resonant materials may be selected for stick 1. Stick 1 and/or its walls may be tapered, but need not be tapered.

Stick 1 is provided with apertures 2 substantially along its length. Apertures 2 may be 0.175" diameter and spaced substantially uniformly 0.3" on center. Stick 1 may be provided with four rows of apertures 2; each row being 90 degrees spaced from its neighbor. Neighboring rows may be staggered so that the centers of apertures 2 are offset from row to row—whereby the uniformity of the width of the webs between apertures 2 is maximized. Each row may have approximately sixty of apertures 2.

Figure 3:
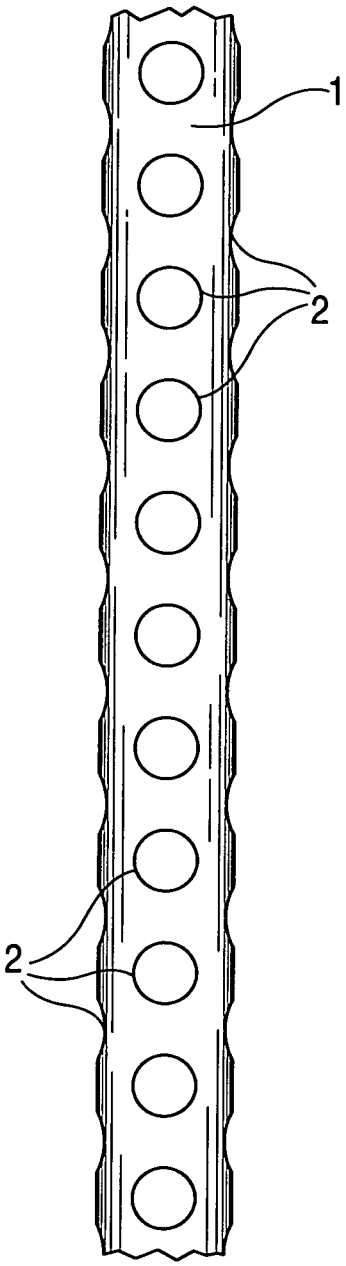
FIG. 3 is a top plan view of the central portion of a perforated stick of a bow according to the invention.

Apertures 2 may alternatively be of varying diameter and spacing from end to center to end, to make stick 1 stiffer in its central region (the region in FIG. 3). Apertures 2 may be of shapes other than circular, such as elliptical, triangular or oblong.

Apertures 2 serve to perforate stick 1 to reduce its weight without unduly affecting its strength. Approximately 40% of the starting weight of stick 1 may be reduced by means of such perforations.

The stated dimensions are for a violin bow, so for other instruments adjustment in dimensions may be made.

Frog 3 is movably engaged upon stick 1 by means of its ring 4 encircling stick 1. Frog 3 is provided with aperture 5. Frog 3 may be, e.g., nylon or filled nylon.

Stick 1 is provided at its frog end with button 6. Button 6 may be wood, metal, nylon or filled nylon. The weight of button 6 may be adjusted as desired to balance the bow assembly. Button 6 may be pressfit into the end of stick 1, or retained therein by adhesive. Button 6 is provided with aperture 7.

Lashing 8 is secured at one end to deadeye 9. Deadeye 9 may be a steel ring.

The other end of lashing 8 when in use passes through aperture 7 of button 6 (as shown in FIG. 1) and may be looped directly around crook 10 of frog 3, directly back to and through deadeye 9, then directly to and through aperture 5 of frog 3, and then be looped around stick 1 multiple times and secured thereto by one or more half-hitches. In this manner, a three-part tackle is arranged to tension frog 3 by drawing it back towards button 6 while holding frog 3 securely to stick 1.

Figure 2:
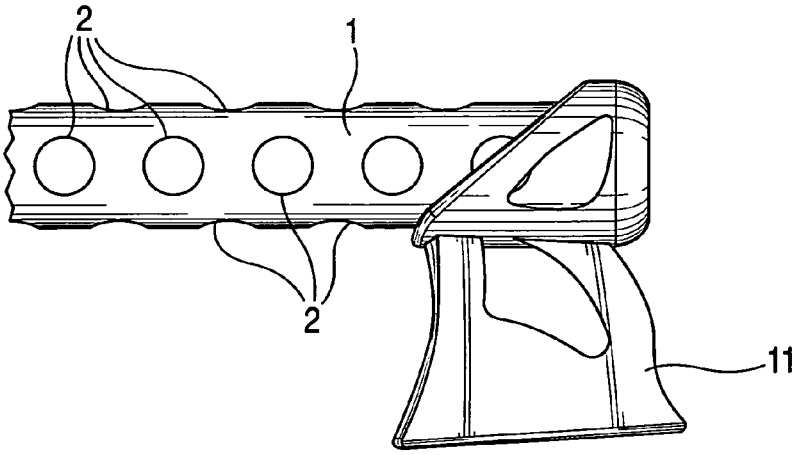
FIG. 2 is a side elevation of the head portion of a bow according to the invention.
Figure 4:
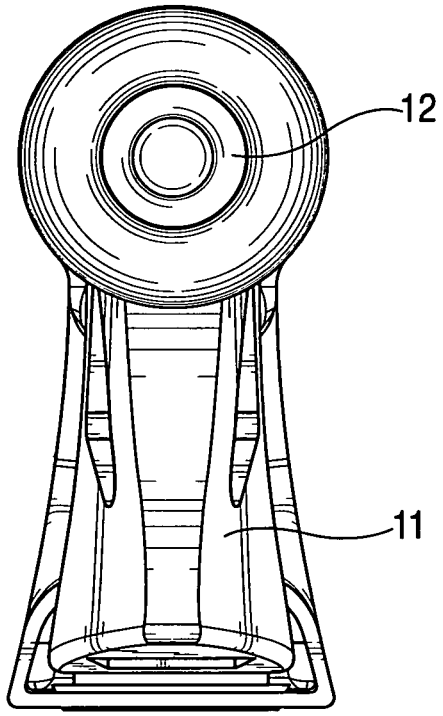
FIG. 4 is an end view of the head of a bow according to the invention.

Referring now to FIGS. 2 and 4, the distal end of stick 1 is inserted into head 11 which may be of the same material as frog 3. Head 11 may be pressfit to stick 1, or secured by adhesive. Stick 1 may be a hollow tube with bore 12 down its central axis.

Referring now to FIG. 3, stick 1 may be provided substantially along its length with rows of perforations 2.

Stick 1 may preferably be pre-cambered with a bend (as is known in the art, e.g., the so-called Tourte-style bow) so that upon tensioning, stick 1 is stiff.

It will be appreciated that frog 3 and head 11 (if not secured by adhesive) may be rotated about the axis of stick 1 when stick 1 is not under tension, whereby the point of maximum camber of stick 1 may be positioned exactly in line with frog 3 and head 11, or alternatively be offset somewhat to the side (so as better to resist side pressure on stick 1 when the hair is not played flat). Such a convenient adjustment is not feasible in the case of the conventional wooden bow in which its head is integral with the stick; and its frog is restrained from rotation by a mortise in the stick.

Frog 3 may according to the invention alternatively be secured to stick 1 in the conventional manner, by an eyelet and screw. However, such conventional arrangement may be less secure than the lashing as above described. Tight lashing of frog 3 to stick 1 may enhance the acoustical properties of the assembly.

A violin bow according to an embodiment of the invention (with a button 6 of maple wood), when assembled with horsehair and a lapping of heatshrink tubing, weighs approximately 53½ grams.

The invention is not limited to the exact embodiments shown and described, and may be realized in such other ways as will be apparent to the skilled artisan, utilizing the teachings of the invention.

The invention claimed is:

1. A bow for stringed musical instrument use comprising a tubular stick provided with a plurality of spaced perforations, a frog, a head, and a tensioning mechanism; said stick having a first end region and a second end region; said frog engaging with said stick within said first end region and defining its extents; said head engaging with said stick within said second end region and defining its extents; and said plurality of spaced perforations comprising perforations located at positions on said stick between said first end region and said second end region.

2. A bow according to claim 1, said tensioning mechanism comprising a tackle having at least a three-times mechanical advantage.

3. A bow according to claim 1, said perforations being substantially circular and arranged in staggered rows.

4. A bow according to claim 3, the number of said rows being at least two.

5. A bow according to claim 3, said stick being aluminum and said frog and head being plastic.

6. A bow according to claim 1, said perforations numbering at least sixteen.

7. A bow according to claim 1, said perforations numbering at least forty and being arranged in at least two rows.

* * * * *